US005454537A

United States Patent [19]

Meeker et al.

[11] Patent Number: 5,454,537

[45] Date of Patent: Oct. 3, 1995

[54] CUP HOLDER

[75] Inventors: Paul K. Meeker, Hiram; William R. Gibson, Canton, both of Ohio

[73] Assignee: Cosco, Inc., Columbus, Ind.

[21] Appl. No.: 182,217

[22] Filed: Jan. 14, 1994

[51] Int. Cl.[6] ..... A47B 17/00

[52] U.S. Cl. ..... 248/220.1; 248/311.2; 248/231.61; 248/215

[58] Field of Search ..... 248/220.1, 231.6, 248/215, 311.2, 230; 211/88, 75; 108/24–26

[56] References Cited

U.S. PATENT DOCUMENTS

| | | | |
|---|---|---|---|
| 1,315,852 | 9/1919 | Mitchell | 248/231.4 |
| 1,527,042 | 2/1925 | Gaut | 248/220.1 X |
| 1,715,715 | 6/1929 | McVey | 248/220.1 X |
| 1,872,491 | 8/1932 | Noetzel | 248/231.5 |
| 2,147,539 | 2/1939 | Marchant | 248/220.1 |
| 2,677,520 | 5/1954 | Marcy | 248/220.1 |
| 3,270,694 | 9/1966 | Wallace et al. | 248/311.2 X |
| 4,088,081 | 5/1978 | D'Arca | 248/231.4 X |
| 5,118,063 | 6/1992 | Young, Sr. | 248/311.2 |

*Primary Examiner*—Karen J. Chotkowski
*Attorney, Agent, or Firm*—Barnes & Thornburg

[57] ABSTRACT

A cup holder is provided to attach to a piece of furniture. The cup holder includes a base formed to include spaced-apart side-by-side cup receiving receptacles, a mounting fixture apended to the base, and spaced-apart furniture engaging clamps apended to the mounting fixture. The mounting fixture includes a V-shaped channel formed by a V-shaped side wall and a V-shaped flange which allows the cup holder to engage two sides of the piece of furniture (e.g., the corner of a table).

25 Claims, 2 Drawing Sheets

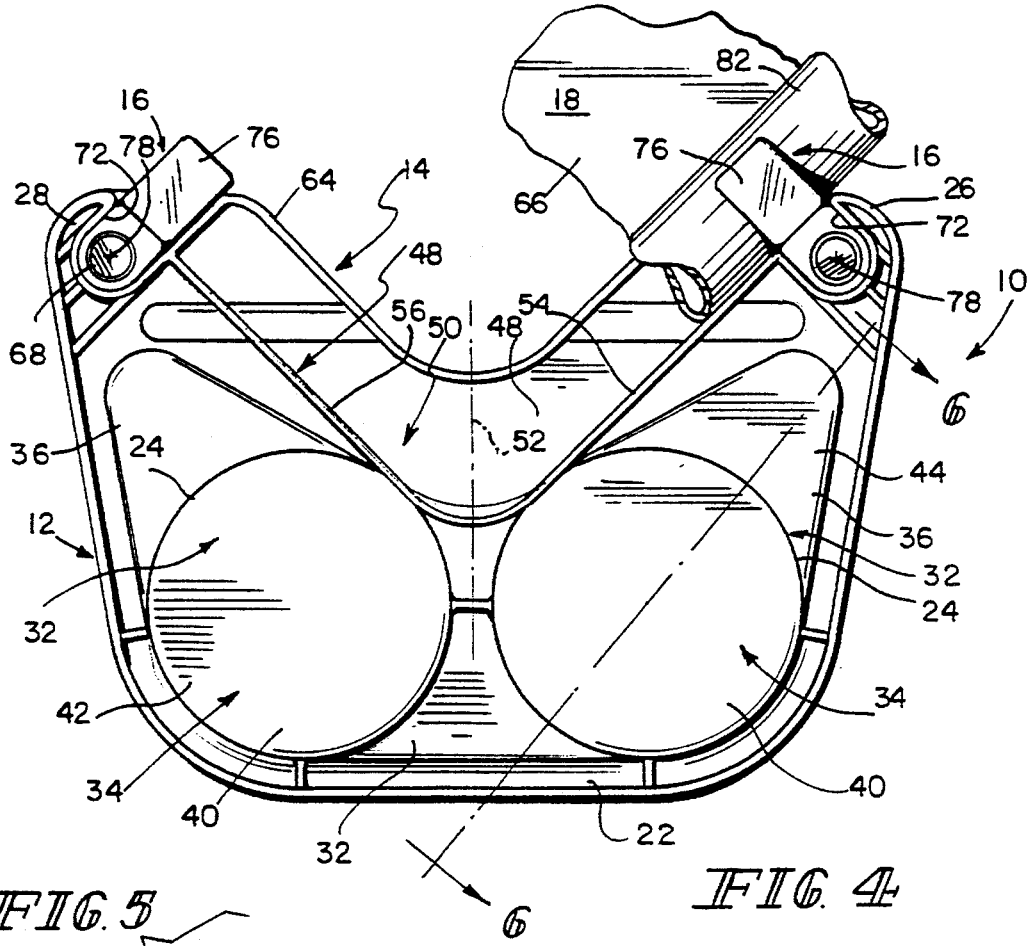
FIG. 4
FIG. 5
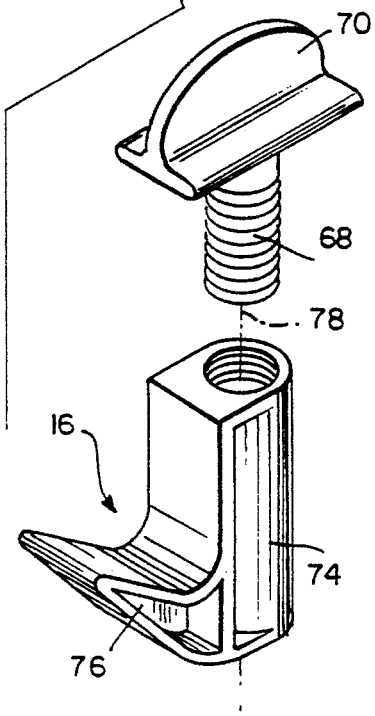
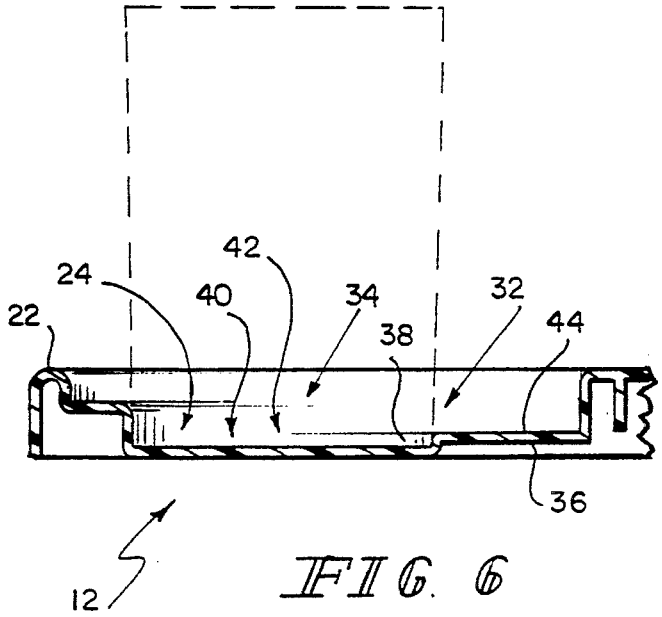
FIG. 6

CUP HOLDER

BACKGROUND AND SUMMARY OF THE INVENTION

The present invention relates to a cup holder. More particularly, the present invention relates to a cup holder that attaches to a piece of furniture.

Cup holders are used to hold cups in a stable and secure position so that the cups are not spilled easily. Cup holders also keep cups away from the working surface of the piece of furniture. This prevents cups from being in the way or knocked off of the table. In addition, placing a cup in a cup holder instead of on a piece of furniture prevents the cup from leaving a wet area on a top surface of the piece of furniture due to the cup "sweating."

What is needed is an improved cup holder that provides a more stable and secure environment for at least one cup and is located in a position less likely to be in the way. It would also be desirable to have a cup holder that is easy to set up and configured to mount on the corner of a folding table.

According to the present invention, a cup holder is provided to attach to a piece of furniture. The cup holder includes a base formed to include spaced-apart side-by-side cup-receiving receptacles, a mounting fixture appended to the base, and spaced-apart furniture-engaging clamps appended to the mounting fixture. The mounting fixture includes a V-shaped channel formed by a V-shaped side wall and a V-shaped flange extending outwardly away from the V-shaped side wall.

Advantageously, the V-shaped channel allows the cup holder to engage two sides of the piece of furniture (e.g., the corner of a table). The placement of the cup holder on the corner of the piece of furniture prevents the cup holder from tipping down. This creates a more stable and secure cup holder. Preferably, the cup holder base and mounting fixture is configured so as to make it easy for a user to mount the cup holder to the corner of a square or rectangular folding card table.

Mounting the cup holder on the corner of a piece of furniture also positions the cups in the cup holder in a stable environment further away from the working surface (e.g. table top) of the piece of furniture. This further decreases the likelihood of cups being in the way or tipped over.

One feature of the cup holder is that each cup-receiving receptacle includes a first cavity and a smaller second cavity within the first cavity. The second cavity supports the cup which leaves extra space in the cup-receiving receptacle for a cup handle and/or miscellaneous items such as playing cards, pens, paper, etc.

In preferred embodiments, the cup holder includes an adjustable furniture-engaging clamp at each end of the mounting fixture. The adjustable furniture-engaging clamps increase the ease of installing and removing the cup holder. Also, the stability of the cup holder is increased because the adjustable clamp is operable to obtain a snug fit between the cupholder and the furniture piece.

Additional objects, features, and advantages of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which:

FIG. 4 is a bottom plan view of the cup holder assembled on the corner of the piece of furniture showing a V-shaped channel for receiving a right-angled portion of the tubular member shown in FIG. 3 and a furniture-engaging clamp gripping the tubular member;

FIG. 5 is an enlarged exploded perspective view of the thumbturn and the adjustable furniture-engaging clamp shown in FIG. 3; and FIG. 6 is a sectional view of the cup holder taken along line 6—6 of FIG. 4 showing the cup-receiving receptacle formed in the base having a first cavity and a smaller second cavity within the first cavity.

DETAILED DESCRIPTION OF THE DRAWINGS

Figure 1:
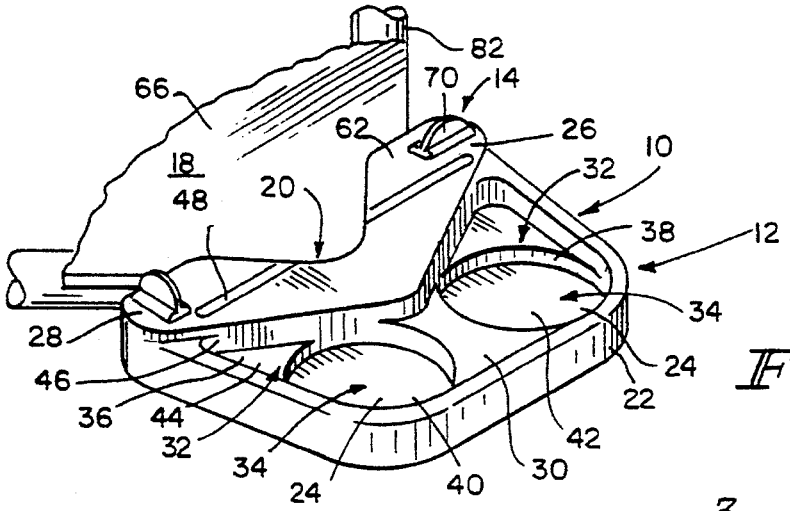
FIG. 1 a perspective view of a cup holder assembled on a corner of a piece of furniture showing a base formed to include side-by-side cup-receiving receptacles, a mounting fixture appended to the base, and two spaced-apart thumbturns positioned at opposite ends of the mounting fixture.

The components of a cup holder 10 are shown in FIGS. 1 and 4. The cup holder 10 includes a base 12, a mounting fixture 14 appended to the base 12, and two adjustable furniture-engaging clamps 16 appended to the mounting fixture 14 and used to anchor the cup holder 10 to a piece of furniture 18. Illustratively, furniture 18 is either a square or rectangular folding card table. A feature of the cup holder 10 is that it is mountable on a corner 20 of the piece of furniture 18 to increase the stability of the cup holder 10 and to move the location of a cup placed on the cup holder 10 away from the working area on the piece of furniture 18 to decrease the chance that such a cup will be tipped over inadvertently.

Figure 2:
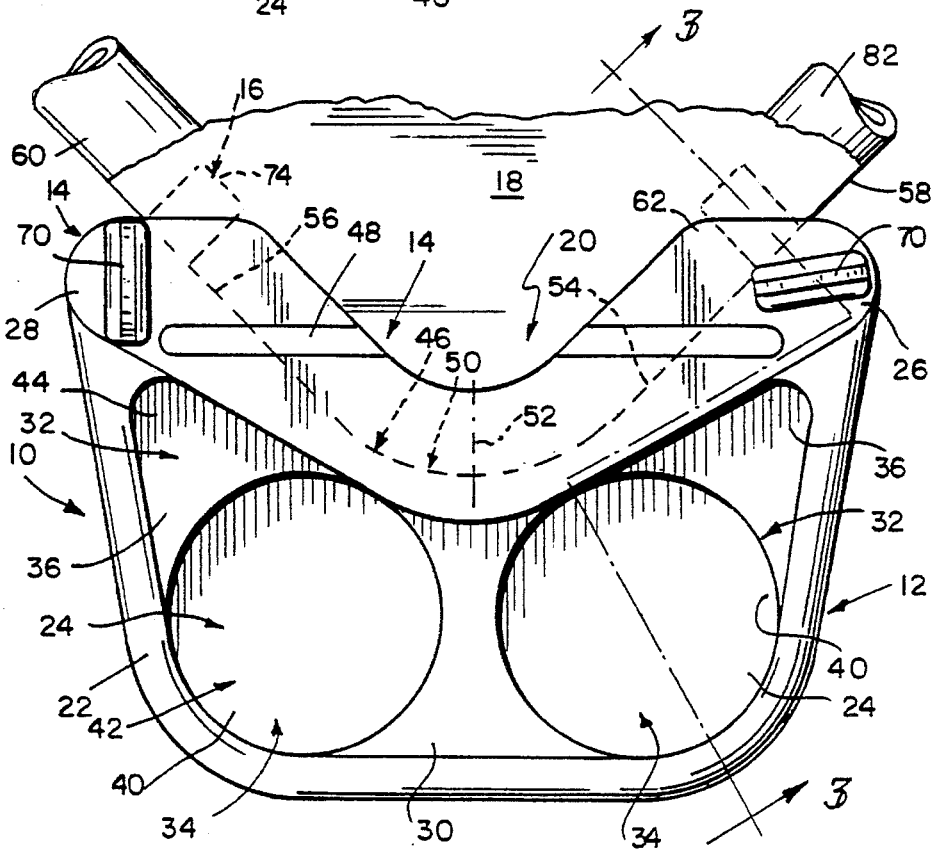
FIG. 2 is a top plan view of the cup holder of FIG. 1 in its mounted position on the corner of the piece of furniture.

The base 12 is formed to include a butterfly-shaped outer retaining wall 22 and spaced-apart, side-by-side, cup-receiving receptacles 24 as shown in FIGS. 1 and 2. The outer retaining wall 22 surrounds the cup-receiving receptacles 24 and extends from a first outside edge 26 of the mounting fixture 14 to a second outside edge 28 of the mounting fixture 14. The cup-receiving receptacles 24 are symmetrically separated by a raised partition 30 that extends from the outer retaining wall 22 to the mounting fixture 14 as shown best in FIGS. 1 and 2.

Each cup-receiving receptacle 24 includes a first cavity 32 and a round smaller second cavity within the first cavity as shown in FIG. 6. The first cavity 32 includes a bottom wall 36 appended to the outer retaining wall 22 and the mounting fixture 14. The round second cavity 34 includes a side wall 38 appended to and extending downwardly away from the bottom wall 36 of the first cavity 32 and a bottom wall 40 extending from the side wall 38 of the round second cavity 34 to the partition 30 as shown in FIGS. 2 and 6. The bottom wall 40 of the round second cavity is appended to the partition 30, mounting fixture 14, outer retaining wall 22, and side wall 38. The bottom wall 40 of the round second cavity 34 is at a lower elevation than the bottom wall 36 of the first cavity 32 to create a support for cups, as shown in FIGS. 1 and 6. The area within the first cavity 32 that is not occupied by a cup placed in the smaller second cavity 34 can be used to hold miscellaneous articles such as playing cards, pens, paper, etc. Thus, each cup-receiving receptacle 24 includes a cup-supporting area 42 and a miscellaneous item area 44.

Figure 3:
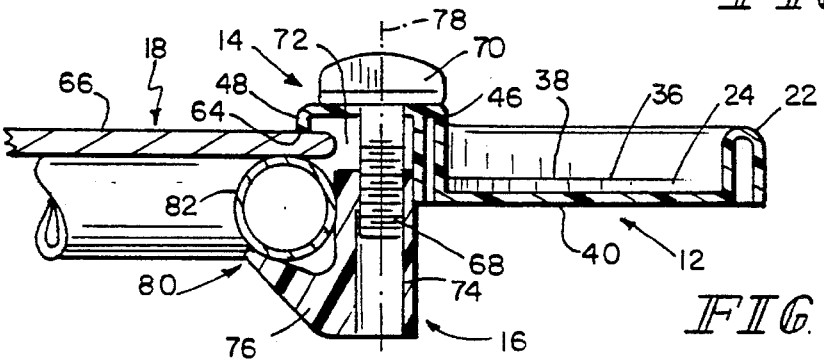
FIG. 3 is a sectional view of the cup holder taken along line 3—3 of FIG. 2 showing one of the two adjustable furniture-engaging clamps gripping a tubular member lying underneath the table top of the piece of furniture.

The mounting fixture 14 includes a V-shaped side wall 46 and a V-shaped flange 48, as shown in FIG. 2. Together, the V-shaped side wall 46 and V-shaped flange 48 form a recessed V-shaped channel 50 that engages the corner 20 of the piece of furniture 18 as shown in FIGS. 2 and 4. The V-shaped side wall 46 is appended to the base 12 as shown in FIGS. 2 and 3. The V-shaped side wall 46 is appended to several parts of the base 12, including the outer retaining wall 22, the bottom wall 36 of the first cavity 32, the bottom wall 40 of the round second cavity 34, and the partition 30. The V-shaped flange 48 is appended to the V-shaped side wall 46 and extends outwardly away from the mounting fixture and over the piece of furniture 14.

A bisecting line 52 intersects the vertex of the V-shaped channel 50 and is arranged to separate the cup-receiving receptacles 24. The bisecting line 52 extends through the partition 30 as shown in FIGS. 2 and 4. The bisecting line 52 divides the V-shaped side wall 46 into a first side wall 54 and a second side wall 56. The first outside edge 26 is located at the opposite end of the first side wall 54 from the bisecting line 52 and the second outside edge 28 is located at the opposite end of the second side wall 56 from the bisecting line 52. The first side wall 54 engages a first side 58 of the piece of furniture 18 and the second side wall 56 engages a second side 60 of the piece of furniture 18. Allowing the cup holder 10 to engage two sides 58, 60 of the piece of furniture 18 increases the stability of the cup holder 10 by preventing it from "tipping down."

The V-shaped flange 48 includes a top surface 62 facing away from the V-shaped channel 50 and a bottom surface 64 facing toward the V-shaped channel 50. The bottom surface 64 of the V-shaped flange 48 engages a top surface 55 of the piece of furniture 18 when the cup holder 10 is assembled as shown in FIG. 3.

The adjustable furniture-engaging clamps 16 are positioned at the first and second outside edges 26, 28 as shown in FIGS. 2 and 4. Each clamp 16 threadedly engages a threaded member 68 appended to the one of the outside edges 26, 28. Each threaded member 68 includes a thumbturn 70 positioned at one of the outside edges 26, 28 on the top surface 62 of the V-shaped flange 48. Each threaded member 68 extends downwardly from the thumbturn 70 through the V-shaped flange 48 and into a rotation-blocking channel 72 located in the V-shaped side wall 46 at one of the outside edges 26, 28.

Each clamp 16 is J-shaped, a shown in FIG. 5, and includes a shaft 74 threadedly appended to the threaded member 68 in the rotation-blocking channel 72 and a hook-shaped member 76 that extends outwardly away from the mounting fixture 14 as shown in FIG. 3. In an assembled position, each hook-shaped member 76 extends under and engages one of the sides 58, 60 of the piece of furniture 18. Each hook-shaped member 76 engages the piece of furniture 18 by rotating the thumbturn 70 in a clamp-tightening direction which rotates the threaded member 68 about an axis of rotation 78. The rotation-blocking channel 72 prevents the shaft 74 of the clamp 16 from freely rotating about the axis of rotation 78. Thus, rotating the thumbturn 70 relative to the clamp 16 about the axis of rotation 78 moves the clamp 16 along the axis of rotation 78. Rotating the thumbturn 70 in a clamp-tightening direction raises the clamp 10 and rotating the thumbturn 70 in a clamp-loosening direction lowers the clamp 16.

Assembling the cup holder 10 onto the corner 20 of the piece of furniture 18 is a quick and simple process. The V-shaped channel 50 engages the corner 20 with the first side wall 54 engaging the first side of the piece of furniture 18, the second side wall 56 engaging the second side 60 of the piece of furniture 18, and the bottom surface 64 of the V-shaped flange 48 engaging the top surface 66 of the piece of furniture 18. The adjustable furniture-engaging clamps 16 are positioned underneath the sides 50, 60 of the piece of furniture 18 and the thumbturns 70 are rotated in the clamp-tightening direction to move the clamps into a furniture-engaging position 80 as shown in FIG. 3. When the clamps 16 are in the furniture-engaging position 80, the piece of furniture 18 is compressively positioned between the hook-shaped members 70 of the clamps 16 and the V-shaped flange 48.

Removing the cup holder 10 from the piece of furniture 18 is also a quick and simple process. The thumbturns 70 are rotated in the clamp-loosening direction to move the clamps 16 into a furniture-releasing position (not shown). Once the clamps 16 are in the furniture-releasing position (not shown), the hook-shaped members 76 no longer engage the piece of furniture 18 and the cup holder 10 can be slid away from the piece of furniture 18.

In preferred embodiments, the clamps 16 engage tubing 82 that extends along the sides 58, 60 of the piece of furniture 18 as shown in FIG. 3. However, the clamps 16 may engage and be securely fastened to many various types of furniture 18.

Also in preferred embodiments, the cup holder 10 is molded plastic. However, in alternative embodiments, any suitable rigid or semi-rigid material may be used.

Placing the cup holder 10 in the corner 20 of the piece of furniture 18 offers several advantages. First, attaching the cup holder 10 to two adjacent sides 58, 60 of the piece of furniture 60 increases the stability of the cup holder 10 and prevents it from tipping down. Second, positioning the cup holder 10 in the corner 18 moves the cups out away from the working area and reduces the chance of the cups being tipped over. Third, this prevents the cups from leaving a wet area on the piece of furniture 18 due to the cup "sweating."

Although the invention has been described in detail with reference to certain preferred embodiments, variations and modifications exist within the scope and spirit of the invention as described and defined in the following claims.

We claim:

1. A cup holder comprising means for holding at least one cup, the holding means including a base formed to include cup support means for supporting a cup, a mounting fixture appended to the base, and an elongated U-shaped channel, and recessed channel means on the holding means for anchoring the mounting fixture to a piece of furniture to retain the cup support means of the base in a fixed position relative to the piece of furniture, the anchoring means including at least one adjustable furniture-engaging clamp appended to the mounting fixture and situated to extend through the elongated U-shaped channel and out through the opening of the U-shape channel and into the recess of the channel means for moving each clamp relative to the mounting fixture between a furniture-engaging position and a furniture-releasing position.

2. The cup holder of claim 1, wherein the mounting fixture is formed to include a V-shaped channel and an adjustable furniture-engaging clamp is positioned at each end of the V-shaped channel.

3. The cup holder of claim 2, wherein the cup support means includes spaced-apart first and second cup-receiving receptacles and the V-shaped channel has a vertex positioned to lie between the first and second cup-receiving receptacles.

4. The cup holder of claim 1, wherein the moving means includes a threaded member threadedly engaging each furniture-engaging clamp and grip means for turning the threaded member relative to the furniture-engaging clamp about an axis of rotation to move the furniture-engaging clamp along the axis of rotation in one of a first direction toward its furniture-engaging position and a second direction toward its furniture-releasing position.

5. The cup holder of claim 4, wherein the U-shaped channel includes means for blocking rotation of the clamp about the axis of rotation during turning of the threaded member about the axis of rotation and the grip means includes a thumbturn fixed to the threaded member to turn the threaded member.

6. The cup holder of claim 4, wherein each clamp is J-shaped and includes a shaft engaged with the threaded member and a hook-shaped member extending outwardly away from the mounting fixture.

7. The cup holder of claim 1, wherein each cup support means includes spaced-apart first and second cup-receiving receptacles and each cup-receiving receptacle includes a first cavity and a smaller second cavity within the first cavity.

8. The cup holder of claim 1, wherein the mounting fixture includes spaced apart first and second ends, a top surface extending between the first and second ends, and first and second adjustable furniture-engaging clamps situated at the first and second ends, the first and second adjustable furniture-engaging clamps include thumbturns situated on the top surface.

9. The cup holder of claim 8, wherein the thumbturns are appended to a threaded member, the furniture-engaging clamps are J-shaped and include a shaft engaging the threaded member and a hook-shaped member extending outwardly away from the mounting fixture, the shaft includes a cylindrical surface and a flat surface, the flat surface engages the U-shaped channel to prevent rotation of the furniture-engaging clamp.

10. A cup holder comprising means for holding an article, the holding means including a base formed to include cup support means for supporting a cup and a mounting fixture appended to the base, the mounting fixture being formed to include a recessed V-shaped channel thereon and spaced-apart elongated U-shaped channels, with the open portion of the U-shaped channels opening into the recess of the V-shaped channel and means for anchoring the mourning fixture to a piece of furniture to retain the cup support means of the base in a fixed position relative to the piece of furniture, the anchoring means extending through the spaced-apart elongated U-shaped channels and into the recess of the V-shaped channel.

11. The cup holder of claim 10, wherein each cup support means includes a first cup-supporting area and a second cup handle-receiving area.

12. The cup holder of claim 10, wherein the anchoring means includes an adjustable furniture-engaging clamp appended to the mounting fixture and means for moving the clamp relative to the mounting fixture between a furniture-engaging position and furniture-releasing position, the moving means includes a threaded member threadedly engaging each clamp and grip means for turning the threaded member relative to the clamp about an axis of rotation to move the clamp along the axis of rotation in one of a first direction toward its furniture-engaging position and a second direction toward its furniture-releasing position.

13. The cup holder of claim 12, wherein the U-shaped channel includes means for blocking rotation of the clamp about an axis of rotation during turning of the threaded member about the axis of rotation and the grip means includes a thumbturn fixed to the threaded member to turn the threaded member.

14. The cup holder of claim 13, wherein the V-shaped channel is formed by a V-shaped side wall and a V-shaped flange extending outwardly away from the V-shaped side wall, the V-shaped side wall is formed to include the rotation blocking means at each end of the V-shaped side wall, the thumbturn is appended to the V-shaped flange, and the threaded member extends downwardly through the V-shaped flange and is threadedly appended to the clamp downwardly from the V-shaped flange.

15. The cup holder of claim 14, wherein each clamp is J-shaped and includes a shaft engaged with the threaded member and a hook-shaped member extending outwardly away from the mounting fixture.

16. The cup holder of claim 10, wherein the anchoring means includes an adjustable furniture-engaging clamp appended to the mounting fixture.

17. The cup holder of claim 16, wherein an adjustable furniture-engaging clamp is situated at each end of the V-shaped channel.

18. The cup holder of claim 16, wherein the cup support means includes spaced-apart first and second cup receiving receptacles situated between adjustable furniture-engaging clamps and the V-shaped channel has a vertex positioned to lie between the first and second receptacles.

19. A cup holder comprising a base formed to include a cup-receiving receptacle, a mounting fixture appended to the base, the mounting fixture having a V-shaped side wall, a V-shaped flange extending outwardly away from the V-shaped side wall to form a recessed V-shaped channel, a first and second outside edge, and a top horizontal surface extending from the first outside edge to the second edge, and first and second adjustable furniture-engaging clamps in U-shaped channels appended to the mounting fixture at the first and second outside edges and positioned in one of a furniture-engaging position and a furniture-releasing position, the first and second adjustable furniture-engaging clamps include a thumbturn having a vertical axis of rotation and situated on the top surface of the mounting fixture to vertical move the clamping means along the U-shaped channel and the recess of the V-shaped channel to the furniture-engaging and releasing positions.

20. The cup holder of claim 19, wherein the first and second adjustable furniture-engaging fasteners are appended to the first and second outside edges.

21. The cup holder of claim 20, wherein the base includes a second cup-receiving receptacle, the V-shaped channel has a vertex positioned to lie between the first and second cup-receiving receptacles, and the first and second adjustable furniture-engaging fasteners are positioned to lie outside of the first and second cup-receiving receptacles.

22. The cup holder of claim 19, wherein the V-shaped side wall includes a rotation-blocking channel at the first and second outside edge, the adjustable furniture-engaging clamp is threadedly appended to a threaded member, the threaded member is appended to the thumbturn, the threaded member extends downwardly from the thumbturn through the V-shaped flange and the rotation-blocking channel, and the adjustable clamp is J-shaped and includes a shaft threadedly engaging the threaded member in the rotation-blocking channel and a hook-shaped member extending outwardly away from the V-shaped side wall.

23. The cup holder of claim 22, wherein the rotation-blocking aperture is formed to block rotation of the clamp about the axis of rotation during rotation of the threaded member about the axis of rotation, the threaded member and clamp are arranged so that when the thumbturn is rotated in a first direction the adjustable furniture-engaging fastener moves into a furniture-engaging position and when the thumbturn is rotated in a second direction the adjustable furniture-engaging fastener moves into a furniture-releasing position.

24. The cup holder of claim 19, wherein each cup-receiving receptacle includes a first cup-supporting area and a second cup handle-receiving area.

25. A method of attaching a cup holder to a corner of a piece of furniture, the method comprising the steps of providing a cup holder having means for holding at least one cup and means for anchoring the cup holder to the piece of furniture to retain the cup support means of the base in a fixed position relative to the piece of furniture, the holding means including a base formed to include cup-receiving receptacles and a mounting fixture appended to the base, the mounting fixture being formed to include an elongated vertically extending U-shaped channel, the anchoring means including at least one adjustable furniture-engaging clamp appended to the mounting fixture and arranged to extend through the elongated U-shaped channel and means for vertically moving the clamp in the U-shaped channel relative to the mounting fixture between a furniture-engaging position and a furniture-releasing position, engaging the mounting fixture and the piece of furniture, the mounting fixture including a V-shaped side wall and a V-shaped flange extending outwardly away from the V-shaped side wall to form a recessed V-shaped channel, the V-shaped channel being formed to engage the corner of the piece of furniture, and moving the furniture-engaging clamp into the furniture-engaging position so that the piece of furniture is compressively positioned between the V-shaped flange and furniture-engaging clamp.

* * * * *